US007624781B2

(12) United States Patent
Yu Chen

(10) Patent No.: US 7,624,781 B2
(45) Date of Patent: Dec. 1, 2009

(54) TAPE DISPENSER WITH A GRIP HAVING A SAFETY TELESCOPIC KNIFE

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 643 days.

(21) Appl. No.: 11/590,913

(22) Filed: Nov. 1, 2006

(65) Prior Publication Data

US 2008/0098534 A1 May 1, 2008

(51) Int. Cl.
*B65H 35/07* (2006.01)

(52) U.S. Cl. ..... 156/523; 156/574; 156/577; 156/579

(58) Field of Classification Search ..... 156/523, 156/526, 574, 577, 579; 206/411; 7/158, 7/160

See application file for complete search history.

(56) References Cited

U.S. PATENT DOCUMENTS

D302,102 S * 7/1989 Amagaya ..... D8/105
6,874,189 B2 * 4/2005 Ackeret ..... 7/160
7,591,037 B1 * 9/2009 Strickland ..... 7/160
2006/0131357 A1 * 6/2006 Yu Chen ..... 225/23

* cited by examiner

*Primary Examiner*—Mark A Osele
(74) *Attorney, Agent, or Firm*—Ming Chow; Sinorica, LLC

(57) ABSTRACT

A tape disperser with a grip having a safety telescopic knife has its grip consisting of a right semi-shell and a left semi-shell. The right semi-shell includes a rectangular pushing recess having a pushing hole for assembling a telescopic knife set that is composed of a knife set, a cutting blade and a connecting board. The knife set and the cutting blade are installed inside the grip to connect with a pushing knob able to be pushed along the pushing recess. The connecting board has a restricting slot for locking with a projecting rib on the knife set to restrict the knife set. A ditch dug on the projecting rib is fitted with a torsion spring to force elastically the cutting blade drawn back into the handle automatically.

5 Claims, 6 Drawing Sheets

TAPE DISPENSER WITH A GRIP HAVING A SAFETY TELESCOPIC KNIFE

BACKGROUND OF THE INVENTION

1. Field of the Invention

This invention relates to a tape dispenser, particularly to one having a telescopic knife in its grip, able to be forced elastically by a torsion spring to retreat back into the grip while not using.

2. Description of the Prior Art

As shown in FIG. 1, a traditional grip cutting device of a tape dispenser includes a grip 1 provided with a penetrating groove 4 cut at a preset side and an accommodating chamber 2 formed inside the handle 1. The grip cutting device also has a blade 3 with a blade grip 5, which is properly contained in the accommodating chamber 2 and the penetrating groove 4, and pivotally connected with a bottom portion of the grip 1 at its one end properly, so that the blade grip 5 can be pulled out by pivoting on an end pivotal hole 6 bore at its bottom portion. In addition, the blade grip 5 is provided with a ditch 7 dug in the other end portion, combined with a pushing blade 8 having its edge installed to expose inclinedly in the ditch 7, so as to be able to cut a tape positioned properly in the ditch 7 while pushed. But, the blade grip 5 has to be moved out from the penetrating groove 4 before cutting each time, it is apt to cause parts relating with the end pivotal hole 6 loosened because of repeatedly swinging the blade grip 5, keeping it unsteady and dangerous for using. Also, if the tape dispenser is dropped down incautiously or unexpectedly, the blade 3 or the pushing blade 8 may collide with the ground to get damaged easily because the blade 3 and the pushing blade 8 are uncovered in the handle 1. Of course, if the blade 3 or the pushing blade 8 is not pushed back after using, it poses a threat to safety, too.

SUMMARY OF THE INVENTION

The objective of this invention is to offer a tape dispenser with a grip having a safety telescopic knife.

The main characteristics of the grip in the invention are a right semi-shell and a left semi-shell that are combined together tightly. The right semi-shell includes a rectangular pushing recess concaved longitudinally at a location of its outer side. The pushing recess is provided with a pushing hole for assembling a telescopic knife set, which consists of a knife set, a cutting blade and a connecting board. There are two projections located in the lower portion of the outer side of the knife set for fitting the cutting blade. The connecting board covered on the inner side of the knife set is provided with a restricting slot set at the bottom of its outer side for fitting a lower portion of a projecting longitudinal rib set on the inner side of the knife set so as to keep the knife set restricted. The projecting rib is provided with a ditch dug longitudinally in its upper portion for fitting a torsion spring therein. In addition, a pushing knob provided with a pushing surface is installed in the pushing recess and connected with the knife set by a screw screwing in a screw hole in the knife set. When the pushing surface is pressed, the cutting blade is to be pushed to extend out. As the pushing force against the pushing surface diminishes, the knife set is to be forced elastically by the torsion spring to draw back the cutting blade into the grip without being exposed nakedly, able to prevent it from damaged or hurting people.

BRIEF DESCRIPTION OF DRAWINGS

This invention is better understood by referring to the accompanying drawings, wherein.

DETAILED DESCRIPTION OF THE PREFERRED EMBODIMENT

Figure 1:
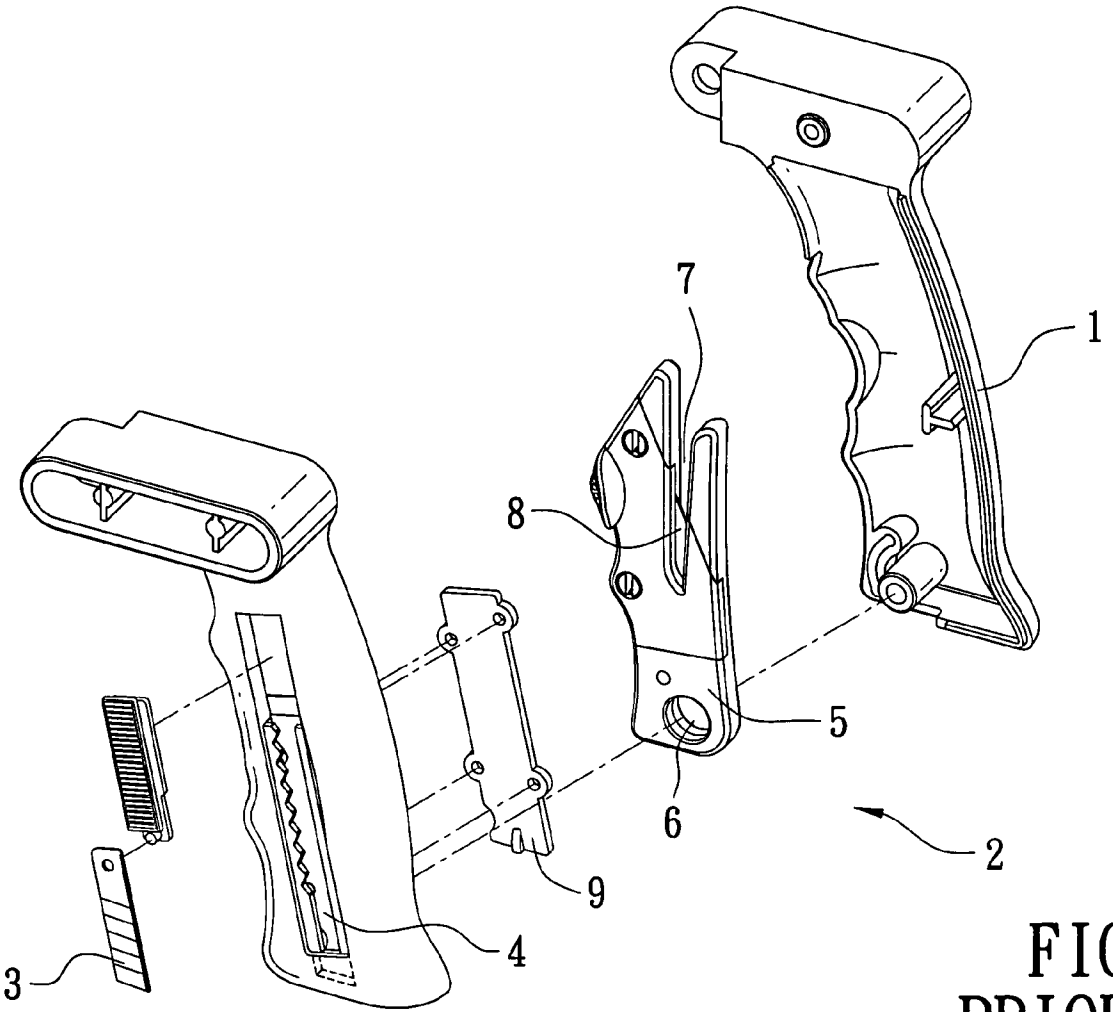
FIG. 1 PRIOR ART
FIG. 1 is an exploded perspective view of a handle of a traditional tape dispenser.
Figure 2:
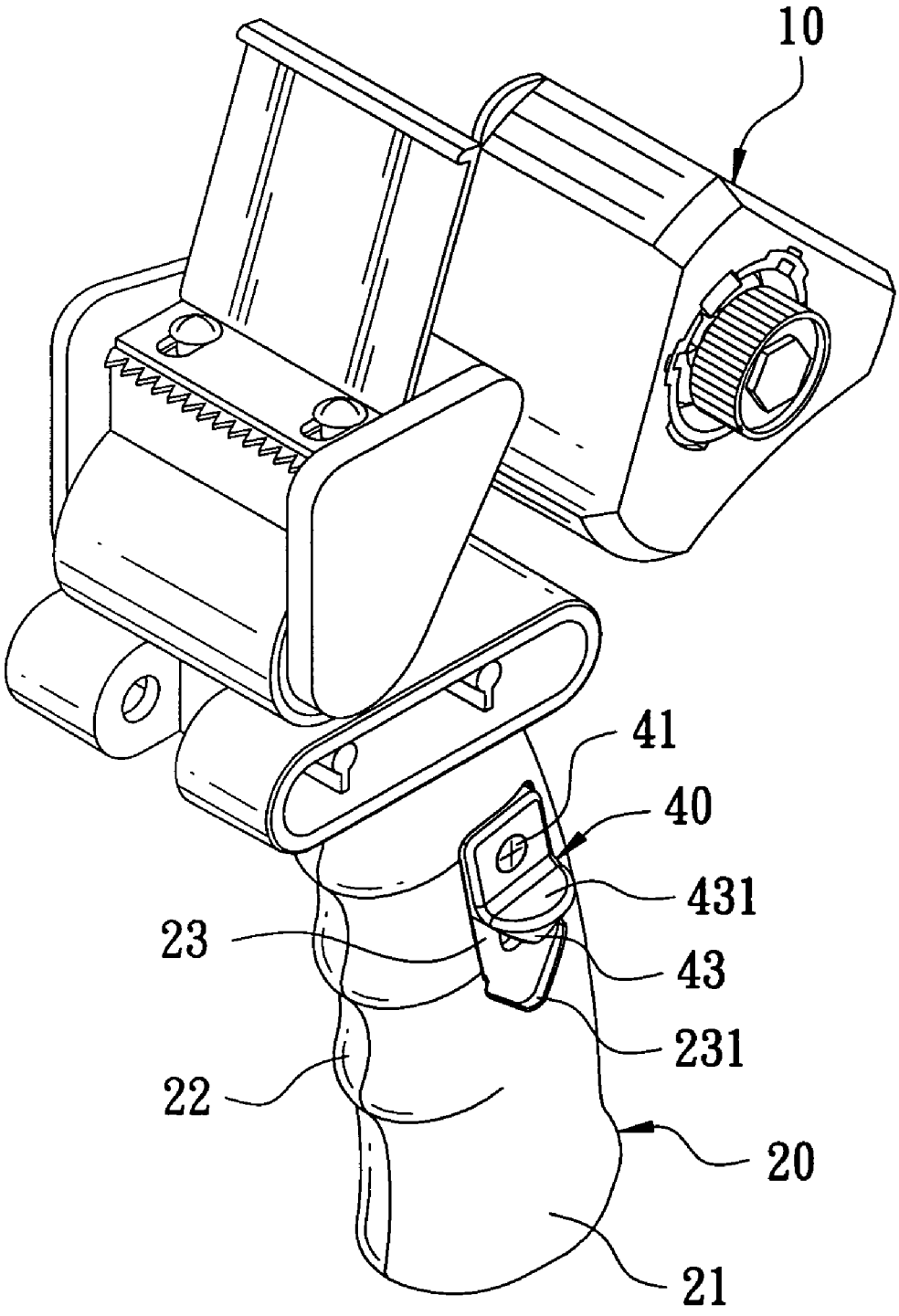
FIG. 2 is a perspective view of preferred embodiment of a tape dispenser with a grip having a safety telescopic knife in the present invention.
Figure 3:
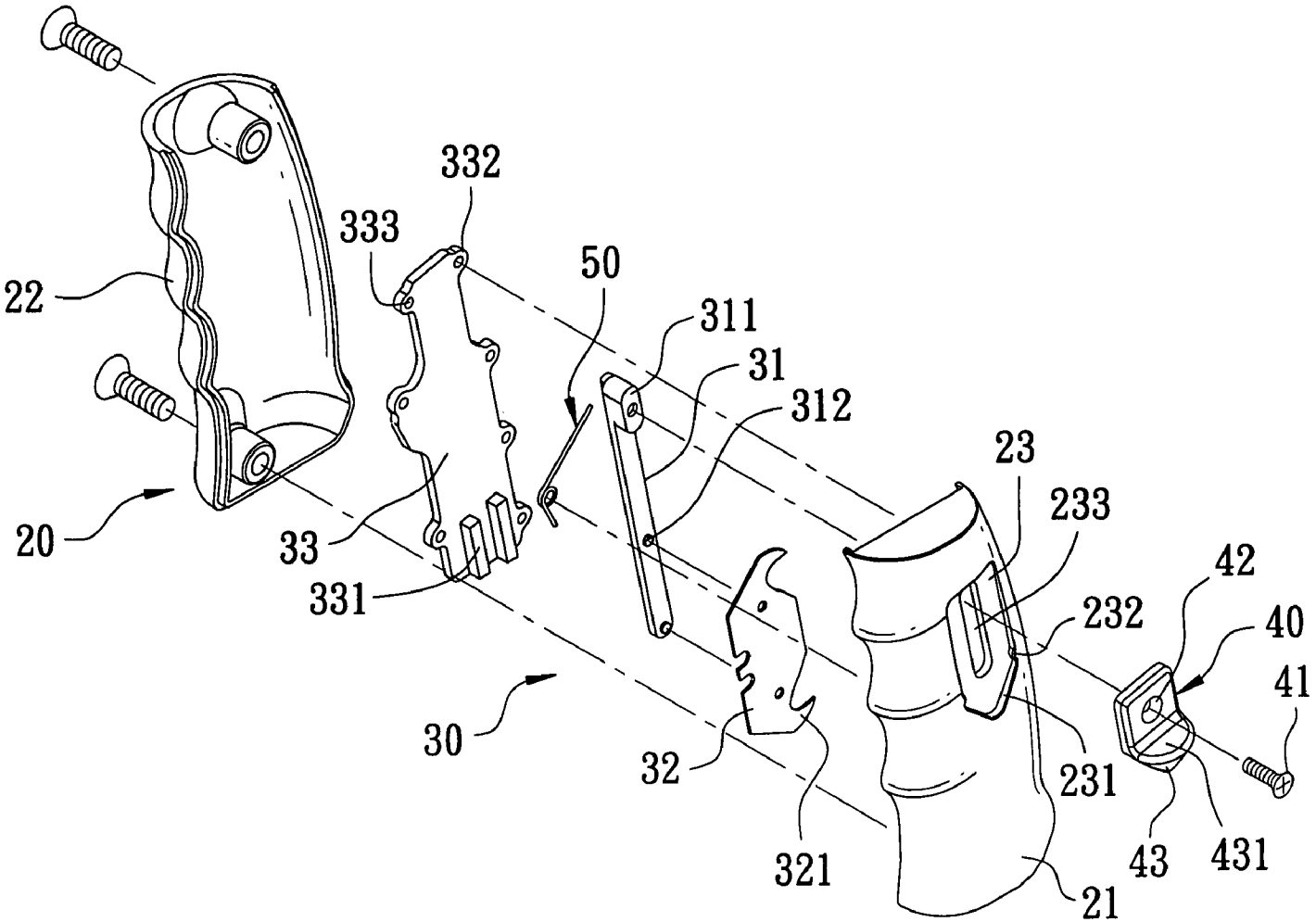
FIG. 3 is an exploded perspective view of a handle of the preferred embodiment of a tape dispenser with a grip having a safety telescopic knife in the present invention.
Figure 4:
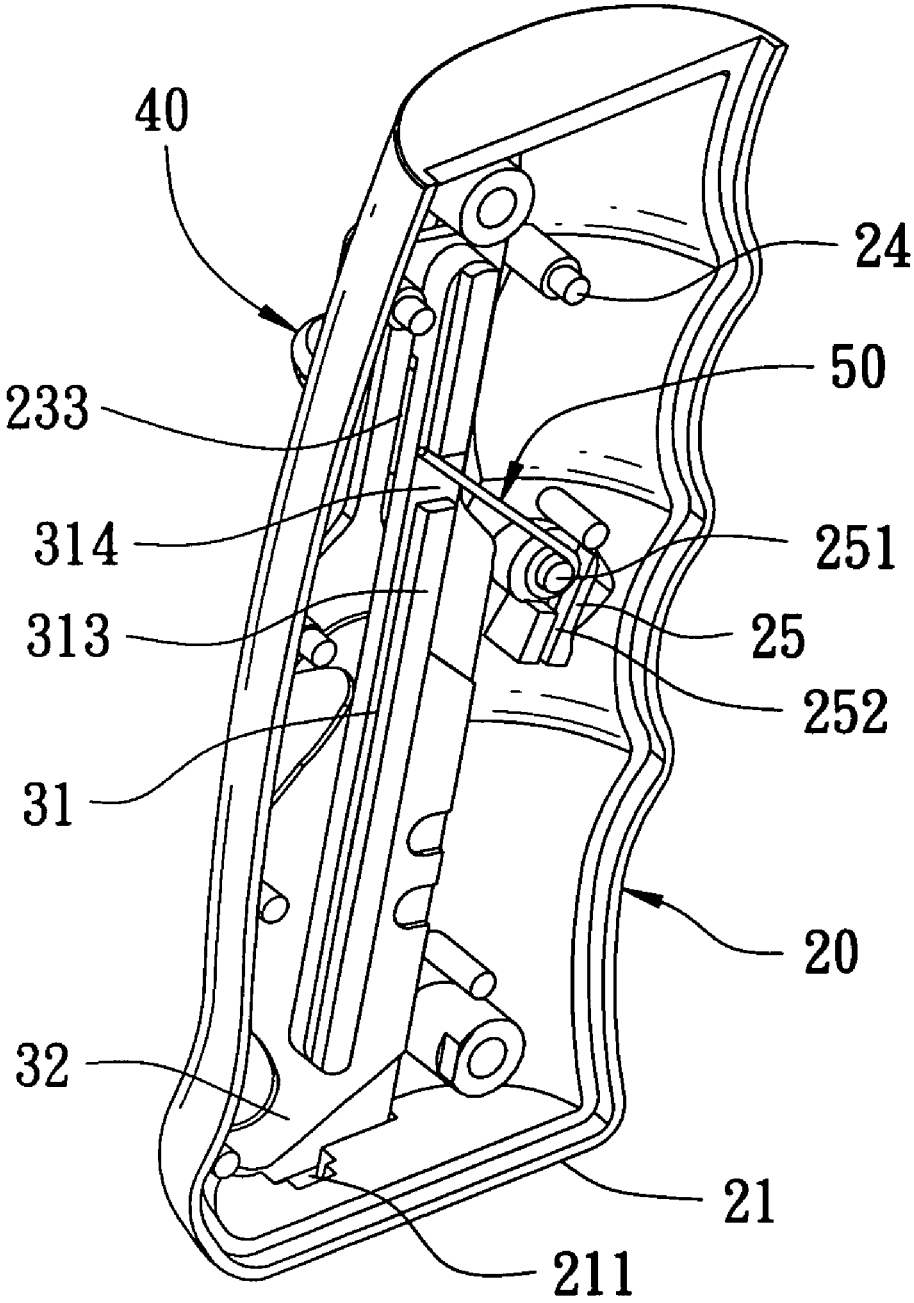
FIG. 4 is a partial perspective view of the handle of the preferred embodiment of a tape dispenser with a grip having a safety telescopic knife in the present invention.

As shown in FIGS. 2~4, a preferred embodiment of a tape dispenser with a grip having a safety telescopic knife includes a tape base 10 and a grip 20 set beneath the tape base 10 for a user to grab, which contains a telescopic knife set 30, a pushing knob 40 and a torsion spring 50.

The grip 20 consists of a right semi-shell 21 and a left semi-shell 22 combined tightly with the right semi-shell 21 together. The right semi-shell 21 is provided with a rectangular pushing recess 23 concaved longitudinally at a preset location of its outer side. The pushing recess 23 has a V-shaped groove 231 extended from its bottom, a projecting rim 232 respectively protruded inwards at two ends of the V-shaped groove 231 connecting with the pushing recess 23, and a pushing hole 233 opened longitudinally. The right semi-shell 21 is additionally provided with plural projecting bars 24 projected around the circumference of its internal wall to be spaced from its edge properly, a spring base 25 set at a preset position located in the center of its right side and abutting to one of the projecting bars 24, and an opening 211 bored at a preset position in the bottom of its exterior side. The spring base 25 is provided with a restricting small projection 251 protruding on its top and a guiding groove 252 concaved in its bottom portion.

The telescopic knife set 30 installed inside the right semi-shell 21 consists of a knife base 31, a cutting blade 32 and a connecting board 33. The knife base 31 includes a pushing head 311 projecting on the top end of its outer side for sliding in the pushing hole 233 to move up and down longitudinally, and two projections 312 set at its lower portion and spaced apart properly for fitting the cutting blade 32. The cutting blade 32 having two hook-shaped blades 321 at its two ends is able to pass through the opening 211 of the right semi-shell 21 to uncover itself for cutting. In addition, the knife base 31 is provided with a projecting longitudinal rib 313 located on its inner side and a ditch 314 dug horizontally in the upper portion of the projecting longitudinal rib 313. The connecting board 33 covered on the inner side of the knife base 31 is provided with a restricting slot 331 defined by two spaced-apart blocks set in the bottom of its outer side for locking with the projecting longitudinal rib 313 of the knife base 31, enabling the knife base 31 restricted immovably while driving the cutting blade 32 to extend out. There are also plural fitting ears 332 provided in the connecting board 33, which are positioned around the circumference of the connecting board 33 and spaced apart properly to correspond to the projecting bars 24 of the right semi-shell 21. Each of the fitting ears 332 has a fitting hole 333 for fitting steadily with the projecting bar 24 so as to keep the knife base 31 fixed inside the right semi-shell 21.

The pushing knob 40, shaped equivalent to the pushing recess 23 and fitted in it, is provided with a locking element 41, a screw hole 42 and a V-shaped cone 43 located at its bottom end to correspond with V-shaped groove 231. The locking element 41 is to pass through the screw hole 42 and the pushing hole 233 of the pushing recess 23 to screw in the pushing block 311 of the knife base 31. The locking element 41 is a screw. The V-shaped cone 43 has a push surface 431 formed on an upper surface, for a user to push the pushing knob 40 to move up and down along the pushing hole 233. In addition, the V-shaped cone 43 of the pushing knob 40 can be moved down in the pushing hole 233 to interlock with the projecting rims 232 of the pushing recess 23.

The torsion spring 50 pivotally fixed with the restricting bar 251 of the spring base 25 of the right semi-shell 21 is fitted in the ditch 314 of the knife base 31 with its one end restricted in the guiding groove 252 with the other end, so that the knife base 31 can be pushed back elastically by the torsion spring 50 to keep the cutting blade 32 retracted in the right semi-shell 21 after being moved in the pushing hole 233.

Figure 5:
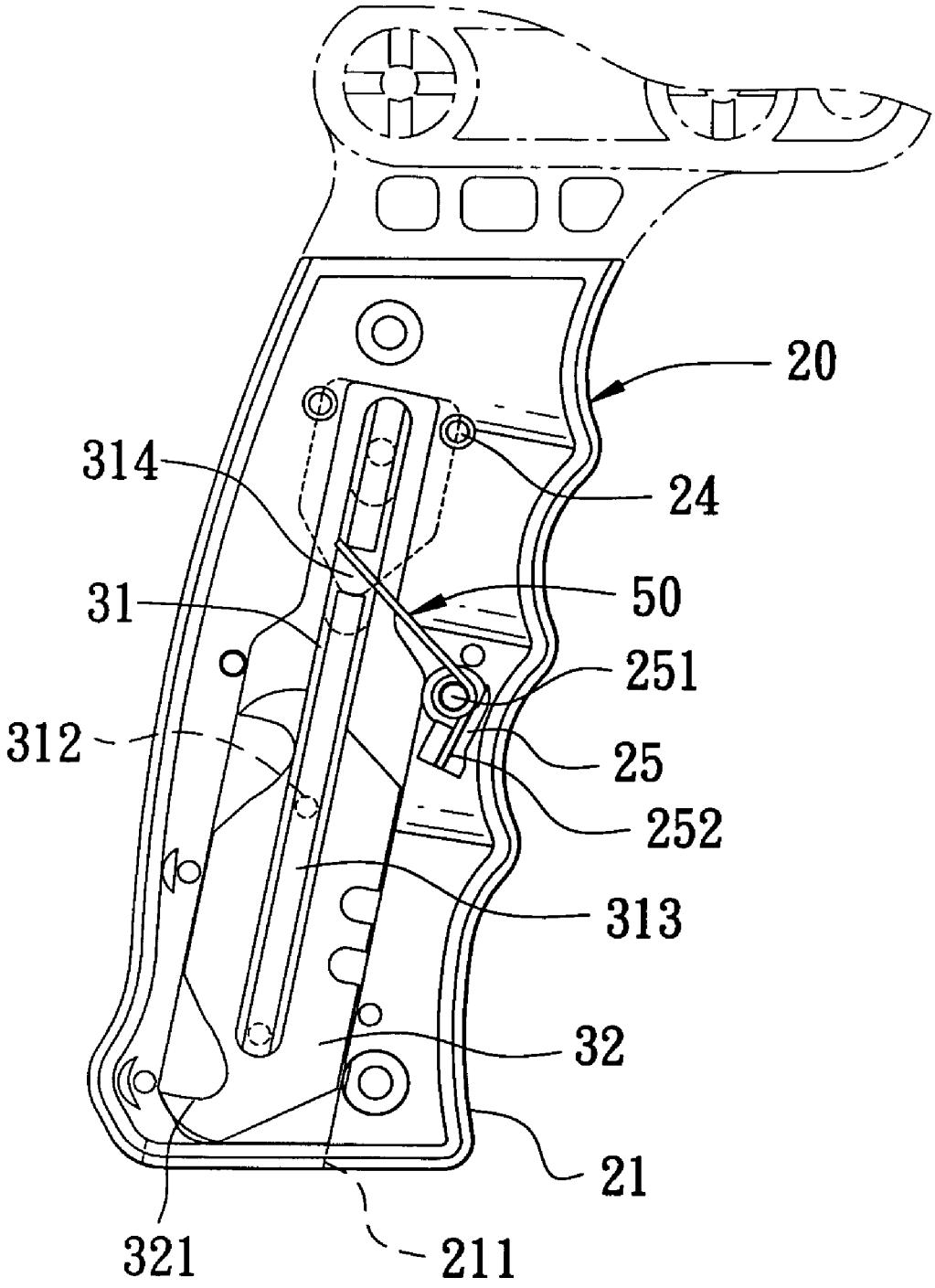
FIG. 5 is a cross-sectional view of the handle of the preferred embodiment of a tape dispenser with a grip having a safety telescopic knife in the present invention, showing a cutting blade hidden in the grip
Figure 6:
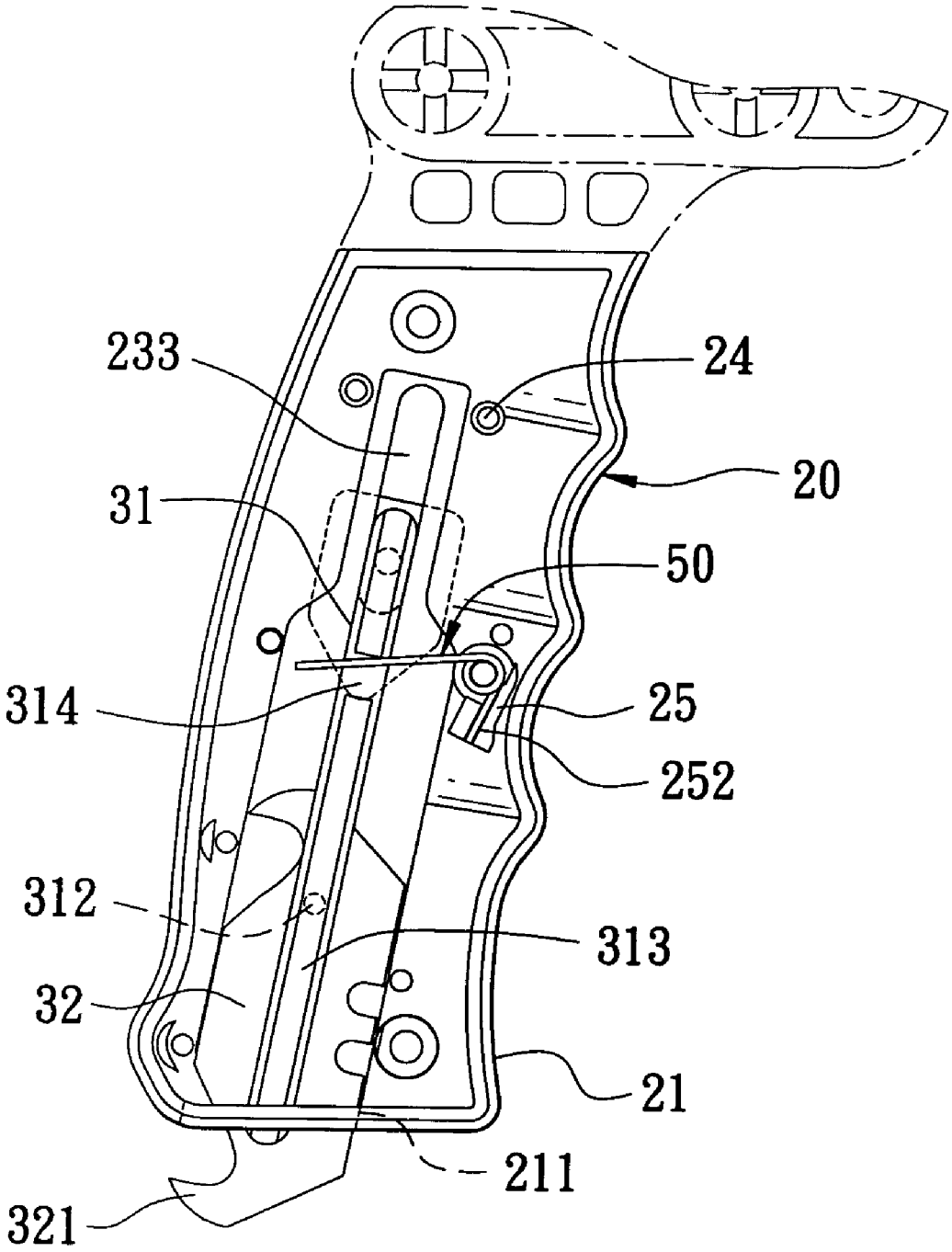
FIG. 6 is a cross-sectional view of the handle of the preferred embodiment of a tape dispenser with a grip having a safety telescopic knife in the present invention, showing the cutting blade extended out of the grip.

In using, as shown in FIG. 5, when the cutting blade 32 is to be used, a user grabs the grip 20 first and then, push the pushing surface 431 of the pushing knob 40 to relatively drive the cutting blade 32 extended out through the opening 211 of the right semi-shell 21 until the pushing knob 40 is fitted stably in the V-shaped groove 231 via locking with the projecting rims 232, ready for carrying out cutting job. On the contrary, after finishing cutting job, it only needs to slightly push the pushing knob 40 to keep it separated from the projecting rims 232, and then, the torsion spring 50 is automatically to push the knife base 31 to slide back into the right semi-shell 21, keeping the cutting blade 32 drawn back into the right semi-shell 21 simultaneously.

The invention has the following advantages as can be seen from the foresaid description.

1. The telescopic knife set 30 is to be automatically pushed back into the handle 20 by the elasticity of the torsion spring 50 while not being used, prevented from causing hurt and used with safety.

2. The V-shaped cone 43 of the pushing knob 40 can be fitted with the V-shaped groove 231 and locked by the projecting rims 232 to keep the pushing knob 40 positioned immovably for cutting job. The locking surface of the V-shaped cone 43 is so small that the cutting blade 32 can be forced back into the handle 20 quickly by the torsion spring 50. And, the pushing surface 431 of the pushing knob 40 makes the invention easy for a user to operate.

3. By means of the locking element 41 screwed to tighten the pushing knob 40 with the knife base 31, it provides a stable assembly. And, the connecting board 33 used to keep the telescopic knife set 30 fixed in the right semi-shell 21 can keep the knife base 31 positioned restrictively by the restricting slot 331 while driving the cutting blade 32 to extend out, guaranteeing a steady operation.

4. The edge of the cutting blade 32 can be formed with different shapes to meet various requirements, able to widen its application.

While the preferred embodiment of the invention has been described above, it will be recognized and understood that various modifications may be made therein and the appended claims are intended to cover all such modifications that may fall within the spirit and scope of the invention.

What is claimed is:

1. A tape dispenser with a grip having a safety telescopic knife comprising:

a tape base;

a grip consisting of a right semi-shell and a left semi-shell combined with said right semi-shell tightly together, said right semi-shell provided with a rectangular pushing recess concaved longitudinally at a preset location of its outer side and a spring base set at a proper position located in the center of its right side, said pushing recess having a pushing hole opened longitudinally, said spring base provided with a restricting bar protruding up on its top and a guiding groove concaved in its bottom portion, said right semi-shell additionally provided with an opening bored at the bottom of its exterior side;

a telescopic knife set installed inside said right semi-shell and consisting of a knife base, a cutting blade and a connecting board, said knife base provided with a pushing block projecting on the top of its outer side for sliding in said pushing hole to move up and down longitudinally and two projections set at its lower portion and spaced apart properly for fitting said cutting blade, said cutting blade able to pass through said opening of said right semi-shell, said knife base also provided with a projecting longitudinal rib located on its inner side and a ditch dug horizontally in the upper portion of said projecting longitudinal rib, said connecting board covered on the inner side of said knife base and provided with a restricting slot set in the bottom portion of its outer side for locking with said projecting longitudinal rib of said knife base to keep said knife base restricted immovably;

a pushing knob fitted in said pushing recess of said right semi-shell and provided with a locking element to pass through said pushing hole of said pushing recess to screw together with said pushing block of said knife base; and a torsion spring pivotally fixed with said restricting bar of said spring base, one end of said torsion spring fitted in said ditch of said knife base and the other end restricted in said guiding groove of said spring base, forcing said knife base to slide automatically back into said handle.

2. A tape dispenser with a grip having a safety telescopic knife as claimed in claim 1, wherein said pushing recess has a V-shaped groove at its bottom end, a projecting rim protruding respectively inwards at two ends of said V-shaped groove connecting with said pushing recess, said pushing knob provided with a V-shaped cone set at its bottom to correspond to said V-shaped groove.

3. A tape dispenser with a grip having a safety telescopic knife as claimed in claim 1, wherein said right semi-shell is provided with plural projecting bars projecting around the circumference of its internal wall and spaced apart properly, said connecting board of said telescopic knife set provided with plural fitting ears located around its circumference to correspond to said projecting bars, each of said fitting ears having a fitting hole for fitting with said projecting bar so as to make stably fixed assemblage.

4. A tape dispenser with a grip having a safety telescopic knife as claimed in claim 2, wherein said V-shaped cone of said pushing knob has a pushing surface formed on its upper surface.

5. A tape dispenser with a grip having a safety telescopic knife as claimed in claim 1, wherein said locking element is a screw.

* * * * *